US005524449A

United States Patent [19]

Ueno et al.

[11] Patent Number: 5,524,449

[45] Date of Patent: Jun. 11, 1996

[54] SYSTEM FOR CONTROLLING OPERATION OF REFRIGERATION DEVICE

[75] Inventors: Takeo Ueno; Hiroto Nakajima, both of Sakai, Japan

[73] Assignee: Daikin Industries, Ltd., Osaka, Japan

[21] Appl. No.: 343,531

[22] PCT Filed: May 27, 1993

[86] PCT No.: PCT/JP93/00712

§ 371 Date: Nov. 29, 1994

§ 102(e) Date: Nov. 29, 1994

[87] PCT Pub. No.: WO93/24795

PCT Pub. Date: Dec. 9, 1993

[30] Foreign Application Priority Data

May 29, 1992 [JP] Japan ..... 4-138682

[51] Int. Cl.[6] ..... F25B 47/02

[52] U.S. Cl. ..... 62/234; 62/278; 62/509

[58] Field of Search ..... 62/155, 234, 278, 62/503, 509, 81, 160

[56] References Cited

U.S. PATENT DOCUMENTS

| | | | |
|---|---|---|---|
| 2,597,729 | 5/1952 | Homeyer | 62/509 X |
| 3,110,164 | 11/1963 | Smith | 62/509 X |
| 4,171,622 | 10/1979 | Yamaguchi et al. | 62/278 X |
| 4,313,313 | 2/1982 | Chrostowski et al. | 62/278 |

FOREIGN PATENT DOCUMENTS

| | | |
|---|---|---|
| 51-63042 | 6/1976 | Japan . |
| 61-60066 | 4/1986 | Japan . |
| 63-15434 | 1/1988 | Japan . |
| 63-120063 | 8/1988 | Japan . |

*Primary Examiner*—Harry B. Tanner

[57] ABSTRACT

A system for controlling operation of a refrigerating device which includes a refrigerant circuit (9) in which a compressor (1), a condenser (6), a receiver (4) for storing liquid refrigerant, a pressure-reducing valve (5), and an evaporator (9) are connected together, and a cycle changeover mechanism (2) for changing a refrigeration cycle of the refrigerant circuit (9) between forward operation and reverse operation, the refrigerating device being of such arrangement that the pressure-reducing valve (5) is positioned downstream of the receiver (4) during either one of the refrigerating cycles. The system prevents liquid back-flow to the compressor at the time of a cycle changeover, while allowing the refrigerating device to have accumulatorless construction. The top portion of the receiver (4) is connected to a liquid line on the downstream side of the pressure-reducing valve (5) through a bypass path (4*a*), and an on-off valve (SV) is provided in this bypass path (4*a*). The on-off valve (SV) is controlled to be opened for a predetermined time before the cycle is switched to a reverse cycle defrost operation. With this arrangement, a liquid refrigerant is recovered by the receiver (4) to prevent liquid back-flow. The on-off valve (SV) of the bypass path (4*a*) is opened during the reverse cycle defrost operation, but only from the time at which defrost has already progressed to a certain extent until the completion of defrost. With this arrangement, an excessive reduction of the low pressure and the liquid back-flow are prevented.

6 Claims, 7 Drawing Sheets

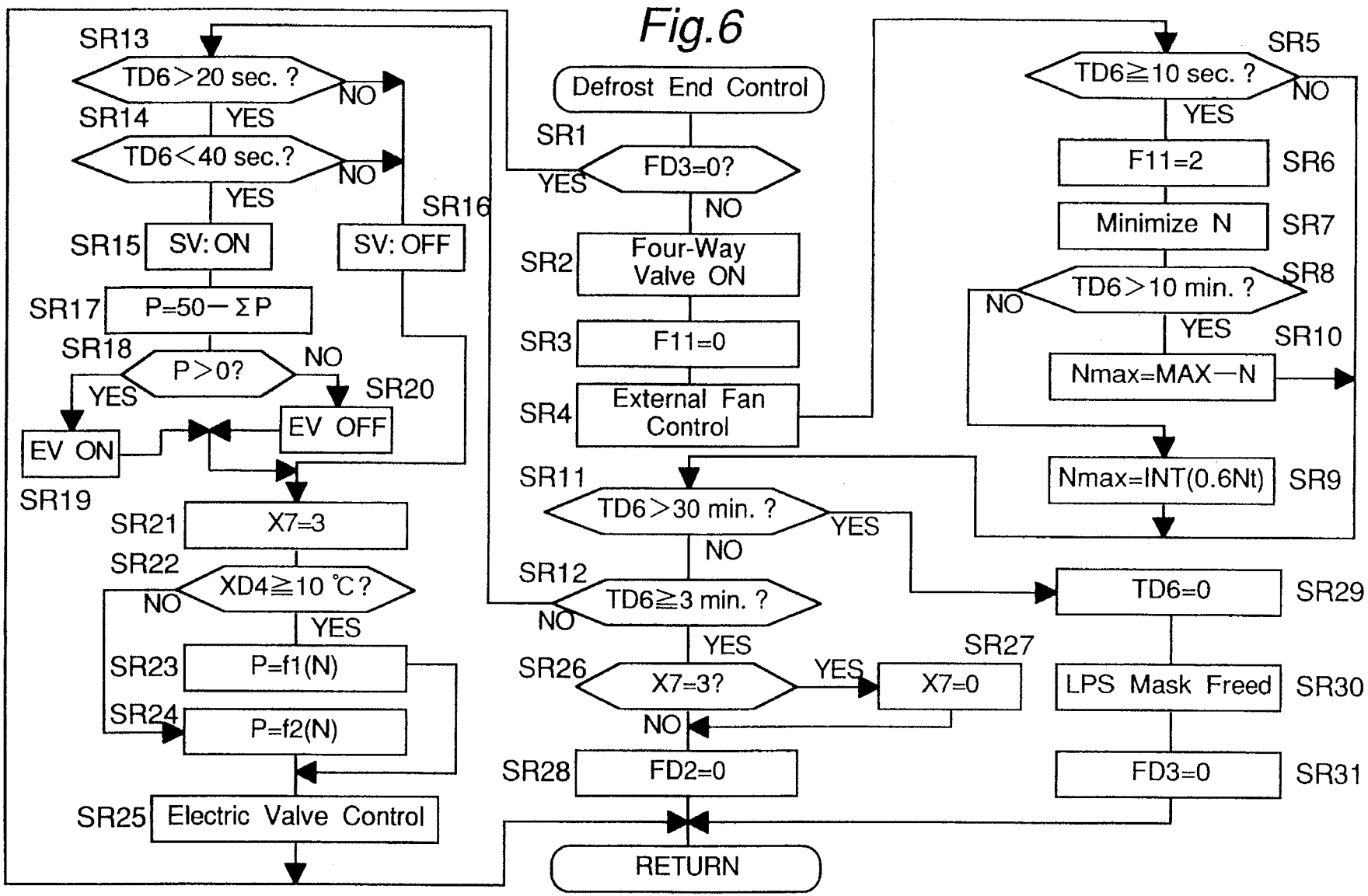
Fig.6
Defrost End Control
SR1
FD3=0?
YES
NO
SR2
Four-Way Valve ON
SR3
F11=0
SR4
External Fan Control
SR5
TD6≧10 sec. ?
YES
NO
SR6
F11=2
SR7
Minimize N
SR8
TD6>10 min. ?
YES
NO
SR9
Nmax=INT(0.6Nt)
SR10
Nmax=MAX−N
SR11
TD6>30 min. ?
YES
NO
SR12
TD6≧3 min. ?
YES
NO
SR13
TD6>20 sec. ?
YES
NO
SR14
TD6<40 sec.?
YES
NO
SR15
SV: ON
SR16
SV: OFF
SR17
P=50−ΣP
SR18
P>0?
YES
NO
SR19
EV ON
SR20
EV OFF
SR21
X7=3
SR22
XD4≧10 °C?
YES
NO
SR23
P=f1(N)
SR24
P=f2(N)
SR25
Electric Valve Control
SR26
X7=3?
YES
NO
SR27
X7=0
SR28
FD2=0
SR29
TD6=0
SR30
LPS Mask Freed
SR31
FD3=0
RETURN

SYSTEM FOR CONTROLLING OPERATION OF REFRIGERATION DEVICE

TECHNICAL FIELD

The present invention relates to a system for controlling operation of a refrigeration device which is arranged to perform a reverse cycle defrost operation and, more particularly, to an arrangement for preventing liquid back-flow to a compressor.

BACKGROUND ART

An air conditioning system including a refrigerant circuit wherein a compressor, a heat source-side heat exchanger, a pressure-reducing valve, and a utilization end-side heat exchanger are sequentially connected and wherein its refrigerating cycle is switchable between forward cycle and reverse cycle, has been known which, as disclosed in, for example, Japanese Utility Model Application Laid-Open No. 63-15434, can perform a so-called reverse cycle defrost operation such that when, during a heating operation, frosting occurs at the heat-source-side heat exchanger, the refrigerant circuit, upon receipt of a defrost command, is operative to switch the refrigerating cycle to a cooling cycle so that a discharge gas refrigerant (hot gas) is flowed into the heat source-side heat exchanger for a predetermined time or until the temperature at the heat-source-side heat exchanger rises to more than a predetermined temperature value, whereby the frost at the heat-source-side heat exchanger is melted for restoring the capability of the heat exchanger.

In such an air conditioning system, when, at the beginning or end of a defrost operation, the refrigerating cycle is forwardly or reversely changed, liquid refrigerant begins to flow toward the compressor as a result of a functional change to an evaporator of the heat-source-side heat exchanger or utilization-side heat exchanger, which has been functioning as a condenser and which, therefore, has a large amount of liquid refrigerant stored therein. In such conventional type of air conditioning system, therefore, an accumulator is disposed before the compressor to absorb the liquid refrigerant thereby to prevent liquid back-flow to the compressor.

With the accumulator so disposed, however, the system may involve various troubles including a power decrease due to pressure reduction, and separation of oil and liquid refrigerant into two phases. Essentially, therefore, an accumulatorless arrangement is desired.

SUMMARY OF THE INVENTION

The present invention has been developed in view of the foregoing facts, and accordingly it is an object of the invention to provide means for causing liquid refrigerant to be efficiently received into the receiver at the start/end of each defrost operation and before a mode changeover in refrigeration cycle takes place, thereby to prevent a liquid flow-back to the compressor without provision of an accumulator.

FIG. 1 is a schematic diagram illustrating the arrangement of the present invention.

A system for controlling operation of a refrigerating device according to the present invention is used in a refrigerating device which, as shown in FIG. 1, includes a refrigerant circuit (9) in which a compressor 1, a condenser 6, a receiver 4 for storing liquid refrigerant, a pressure-reducing valve 5, and an evaporator 9 are connected together, and a cycle change-over mechanism 2 for changing a refrigeration cycle of the refrigerant circuit 9 between forward operation and reverse operation, the refrigerating device being of such arrangement that the pressure-reducing valve 5 is positioned downstream of the receiver 4 during either one of the refrigerating cycles. And the system comprises:

a bypass path **4*a* connecting a top portion of the receiver 4 to a liquid line on the downstream side of the pressure-reducing valve 5**;

a normally closed on-off valve SV for opening and closing the bypass path defrost operation control means 51 for switching the cycle change-over mechanism 2 to a reverse cycle position upon receipt of a defrost command during operation of the refrigerating device, thereby to control the device so as to perform a defrost operation; and at least one of (a) a before-defrost on-off control means 52 for controlling the on-off valve SV to be opened for at least a predetermined period of time preceding a change-over to a reverse cycle operation via the defrost operation control means 51, (b) a during defrost on-off control means 53 for controlling the on-off valve SV to be opened during a reverse cycle defrost operation effected through the defrost operation control means 51, but from a time at which melting of frost built on the evaporator 3 has progressed a predetermined degree until completion of the defrost operation, and (c) an after-defrost valve control means 54 for controlling the on-off valve SV and the pressure-reducing valve 5 such that after completion of the reverse cycle defrost operation effected by the defrost operation control means 51, the on-off valve SV and the pressure reducing valve 5 are closed for a predetermined time and thereafter the on-off valve SV is opened for a predetermined time while the pressure reducing valve 5 is opened a predetermined low degree of valve travel.

With the above described arrangement, where there is provided a before-defrost on-off control means 52, the before-defrost on-off control means 52, upon receipt of a defrost command during operation of the refrigerating device, causes the on-off valve SV for the bypass path **4*a* to be opened at least for a predetermined time before the commencement of a reverse cycle defrost operation via the defrost operation control means 51. As a result, the pressure in the receiver 4 is decreased so that the liquid refrigerant in the condenser 6 is moved to the receiver 4. Thus, when there is almost no liquid refrigerant left in retention in the condenser 6, the cycle of operation is switched over to a reverse cycle such that the condenser 6 is functionally changed into an evaporator, whereby liquid back-flow to the compressor 1** can be prevented.

After commencement of the reverse cycle defrost operation, as the melting of the frost built up on the evaporator 3 progresses, there is a temperature rise at the evaporator (which acts as a condenser during the reverse cycle operation) 3, while on the other hand the temperature of the condenser (which acts as an evaporator during the reverse cycle) 6 is lowered. As a result, the pressure on the low pressure side is lowered and the refrigerant being sucked tends to become somewhat excessively wet. Where there is provided a during-defrost on-off control means 53, however, this control means 53 will cause the on-off valve SV of the bypass path **4*a* to be opened so that gas refrigerant is introduced into the condenser 6 which is presently acting as an evaporator, whereby any excessive pressure reduction on the low pressure side can be prevented. The wetness of the refrigerant is also eliminated. Thus, liquid back-flow to the compressor 1** is prevented. Further, any abnormal shutdown due to low-pressure cut-out can be prevented.

At the end of the defrost operation, a changeover in operation cycle takes place so that the evaporator 3 which has been acting as a condenser can resume its inherent function as evaporator. In this case, where there is provided an after-defrost valve control means 54 as above described, the pressure-reducing valve 5 and on-off valve SV are closed for a predetermined time, so that refrigerant supply to the evaporator 3 is shut off. Thus, liquid back-flow from the evaporator 3 to the compressor 1 is prevented.

Upon lapse of a predetermined time after a cycle change-over to forward cycle, the after-defrost valve control means 54 controls the electric expansion valve 5 to a small degree of valve travel and causes the on-off valve SV to be opened so that refrigerant flows from the condenser 6 into the receiver 4 to restrain a rise in the pressure on the high pressure side, whereby a high pressure cut-out is prevented. Thus, the pressure on the high pressure side is maintained at a proper level and liquid back-flow to the compressor 1 is positively prevented.

Preferably, the before-defrost on-off control means 52, the during-defrost on-off control means 53, and the after-defrost valve control means 54 are all provided in position. Through such arrangement is it possible to positively prevent a liquid back-flow that may possibly occur during a reverse-cycle defrost operation.

Where the on-off valve SV is controlled by the before-defrost on-off control means 52 so that it will be opened before and after aforesaid cycle change-over to reverse cycle, gas refrigerant is introduced into the condenser 6 which is now acting as an evaporator, through the on-off valve SV which is opened after the change-over to reverse cycle. This provides for more positive prevention of any liquid back-flow that may otherwise occur after the change-over to reverse cycle.

According to the present invention, the refrigerating device may be arranged to be of an accumulator-less construction. In other words, the evaporator 3 and the condenser 6 are both connected to the compressor 1 without requiring the presence of an accumulator. Such accumulator-less construction for the refrigerating device provides for cost reduction and eliminates the problem of capability decrease due to pressure drop as well as the problem of two-phase separation with respect to oil and liquid refrigerant.

BRIEF DESCRIPTION OF THE DRAWINGS

FIG. 6 is a flow chart showing details of defrost termination control; and

BEST MODE EMBODIMENT OF THE INVENTION

An embodiment of the present invention will now be described with reference to the accompanying drawings.

Figure 1:
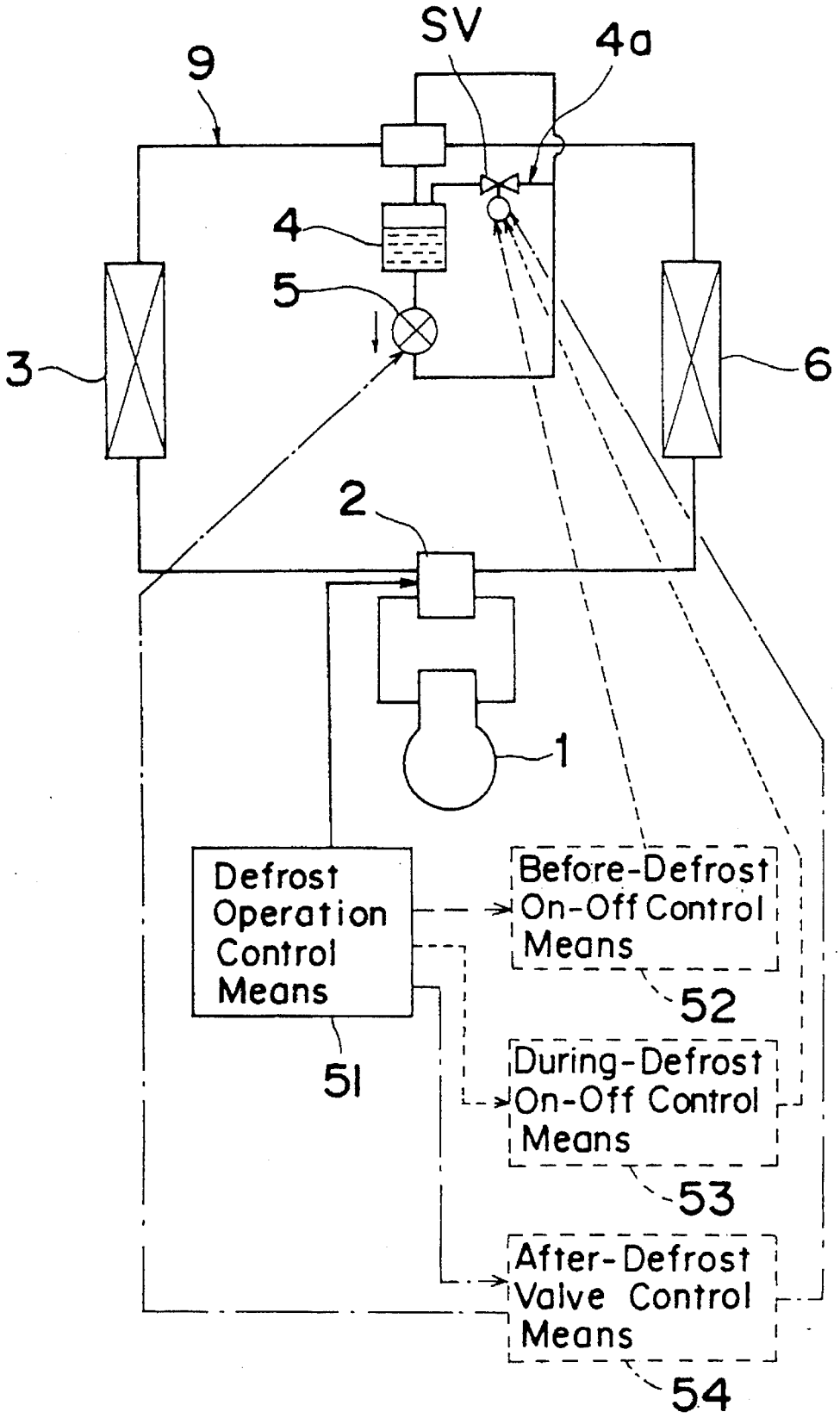
FIG. 1 is a block diagram showing the arrangement of the present invention.
Figure 2:
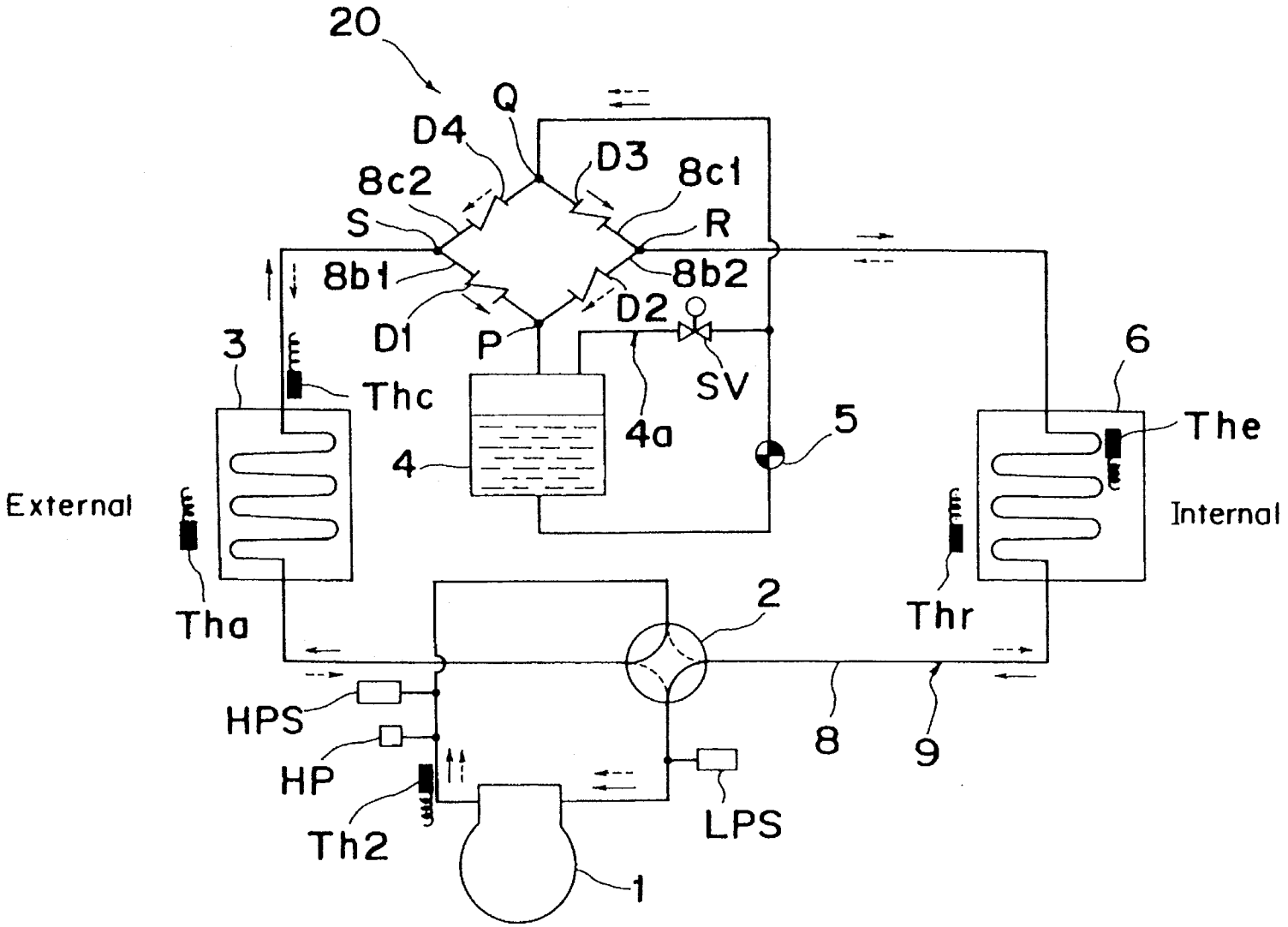
FIG. 2 is a system diagram showing a pipeline arrangement for an air conditioning system representing one embodiment of the invention.

FIG. 2 illustrates a refrigerant piping system in an air conditioning system representing one embodiment of the invention. There are arranged a scroll type compressor 1 whose operating frequency is variably adjustable by an inverter (not shown), a four-way changeover valve 2 which is switchable as shown by solid lines for a cooling operation and as shown by broken lines for a heating operation, an exterior heat exchanger 3 which functions as a condenser during cooling operation and as an evaporator during heating operation, a receiver 4 for storing a liquid refrigerant, an electric expansion valve 5 which acts as a pressure reducing valve for reducing the pressure of refrigerant, and an internal heat exchanger 6 which functions as an evaporator during the cooling operation and as a condenser during the heating operation. These units are sequentially interconnected by a refrigerant pipe line 8 thereby to form a refrigerant circuit 9 for causing a heat flow through refrigerant circulation.

In a liquid line of the refrigerant circuit 9 there is provided a rectifier mechanism 20 including a point P upstream of the receiver 4, a point Q downstream of the electric expansion valve 5, a point R communicating with the internal heat exchanger 6, and a point S communicating with the external heat exchanger 3, which points are interconnected in a bridge fashion through check valves or the like. In the rectifier mechanism 20, the points P and S are interconnected by a first inflow pipe **8*b*1 through a first check valve D1 which only allows passage of refrigerant from the external heat exchanger 3 side toward the receiver 4, and the points P and R are interconnected by a second inflow pipe 8*b*2 through a second check valve D2 which only allows passage of the refrigerant from the internal heat exchanger 6 side toward the receiver 4, while the points Q and R are interconnected by a first exit flow pipe 8*c*1 through a third check valve D3 which only allows passage of the refrigerant from the electric expansion valve 5 side toward the internal heat exchanger 6, and the points Q and S are interconnected by a second exit flow pipe 8*c*2 through a fourth check valve D4 which only allows passage of the refrigerant from the electric expansion valve 5 side toward the external heat exchanger 3. That is, whether in a cooling cycle or in a heating cycle, rectification is made so that the refrigerant flows in the sequence of the condenser 3 or 6→the receiver 4→the electric expansion valve 5→ evaporator 6 or 3**.

There is also provided, via an on-off valve SV, a gas bypass path **4*a* for bypassing gas refrigerant from the top of the receiver 4 to a liquid pipe extending between the electric expansion valve 5 and the point Q. The on-off valve SV is a normally closed on-off valve such that when there is need for liquid refrigerant being stored in the receiver 4, the on-off valve SV is opened to reduce the pressure of the refrigerant in the receiver 4 thereby to enable the refrigerant storing capacity of the receiver 4** to be maintained.

In the present embodiment, there is no accumulator disposed at an intake pipe of the compressor 1, it being arranged that the internal heat exchanger 6 is directly connected with the compressor 1 during the cooling operation, while the external heat exchanger 3 is directly connected with the compressor 1 during the heating operation. Briefly, this means an accumulatorless arrangement in which an evaporator is directly connected with the compressor 1.

In the embodiment, the rectifier mechanism 20 is provided for rectifying the flow of refrigerant. It is understood, however, that the invention is not particularly limited to such embodiment. For example, electric expansion valves 5 may be disposed both internally and externally, with the liquid-refrigerant storing receiver 4 being interposed between the two electric expansion valves 5, provided, however, that in such case gas bypass paths 4*a* be provided which extend from the top of the receiver 4 to the respective electric expansion valves 5 and further to the respective heat exchangers 3, 6, with on-off valves SV interposed in the respective bypass paths.

Further, the air conditioning system is provided with various sensors. Th2 denotes a discharge pipe sensor disposed at a discharge pipe for sensing discharge pipe temperature T2, Tha denotes an external air intake sensor disposed at an air intake port of the external heat exchanger 3 for sensing outdoor air temperature, Thc denotes an external heat exchange sensor, i.e., a deicer, which is disposed at the external heat exchanger 3 for sensing condensation temperature Tc during cooling operation and for sensing evaporation temperature Te during heating operation, Thr denotes an internal air intake sensor disposed at an air intake port of the internal heat exchanger 6 for sensing room temperature, The denotes an internal heat exchange sensor disposed at the internal heat exchanger 6 for sensing evaporation temperature Te during cooling operation and for sensing condensation temperature Tc during heating operation, HPS designates a high pressure-side pressure switch which is turned on to actuate a protective device upon an excessive rise in the high pressure-side pressure, and LPS designates a low pressure-side pressure switch which is turned on to actuate the protective device upon an excessive decrease in the low pressure-side pressure. Connections are provided so that signals from the various sensors can be input to a controller (not shown) which controls the operation of the air conditioning system, whereby the operation of the air conditioning system may be controlled by the controller according to the signals from the respective sensors.

In the refrigerant circuit 9, during the cooling operation, a liquid refrigerant resulting from condensation at the external heat exchanger 3 follows a circulation path such that it flows through the first inflow pipe 8*b*1 into the receiver 4 for being stored therein and, after being subjected to pressure reduction at the electric expansion valve 5, the liquid refrigerant flows through the first exit flow pipe 8*c*1 into the internal heat exchanger 6 in which the liquid refrigerant is evaporated, the evaporated refrigerant being then returned to the compressor 1 (see solid line arrows in the figure). During the heating operation, a liquid refrigerant resulting from condensation at the internal heat exchanger 6 follows a circulation path such that it flows through the second inflow pipe 8*b*2 and via the second check valve D2 into the receiver 4 for being stored therein and, after being subjected to pressure reduction at the electric expansion valve 5, the liquid refrigerant flows through the second exit flow pipe 8*c*2 into the external heat exchanger 3 in which the fluid refrigerant is evaporated, the evaporated refrigerant being then returned to the compressor 1 (see broken line arrows in the figure).

The manner of a defrost operation during the heating operation will now be described with reference to the flow charts in FIGS. 3 to 6 and the time chart in FIG. 7.

Figure 3:
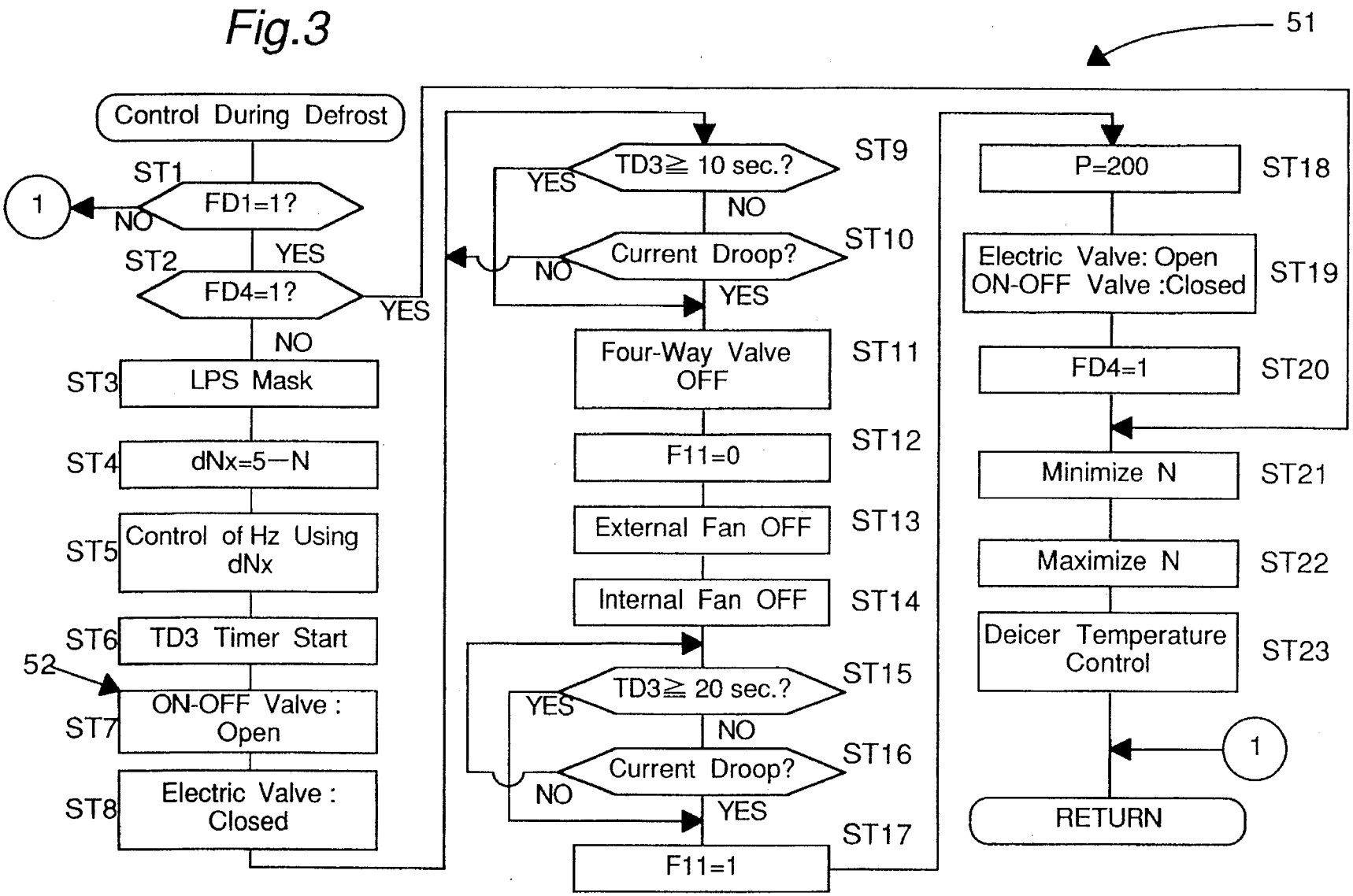
FIG. 3 is a flow chart showing details of defrost operation control.

Initially, particulars of control procedure at the start of the defrost operation are explained with reference to FIG. 3. First, at step ST1, decision is made whether a defrost flag FD1, which is "0" in normal operation and "1" in defrost operation, is "1" or not. When frosting occurs at the external heat exchanger 3 and the defrost flag FD1 is shown as "1", control proceeds to step ST2 at which decision is made whether an initial defrost flag FD4, which is "1" only during an initial defrost operation, is "1" or not. If FD4 is not "1", control proceeds to step ST3, where LPS masking is made which prohibits the actuation of the low pressure-side pressure switch LPS. At step ST4, a frequency computing variable dNx is calculated on the basis of dNx=5−N (where N denotes frequency step value) and, at step ST5, an operating frequency Hz of the compressor 1 is controlled on the basis of the frequency computing variable dNx. At step ST6, a TD3 timer for actuating a defrost end circuit is set to start.

Figure 7:
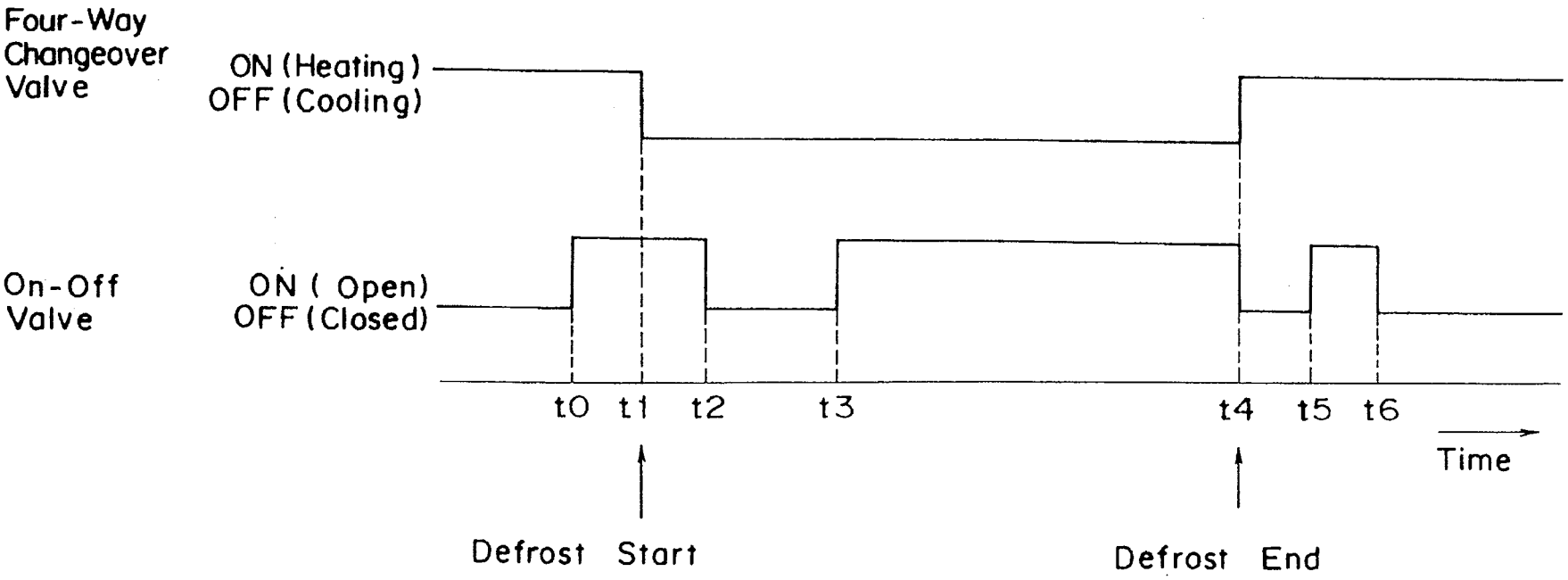
FIG. 7 is a time chart showing operation modes and on-off changes of the on-off valve.

Next, at step ST7, the on-off valve SV at the bypass path 4*a* for the receiver 4 is opened and, at step ST8, the electric expansion valve 5 is fully closed (at time t0 in FIG. 7). The pressure in the receiver 4 is thus reduced and a pump-down operation is carried out for collecting the liquid refrigerant present in the internal heat exchanger 6 into the receiver 4. Then, at step ST9, decision is made whether or not a count TD3 at the TD3 timer for actuating the defrost end circuit has reached 10 seconds or more, and at step ST10, decision is made whether there is a decrease of a current or not. When TD3≧10 (sec) or a decrease of a current does exist, control proceeds to step ST11 at which the four-way changeover valve 2 is turned off so that operation is changed to a reverse cycle, i.e., a cooling-side operation. Then, there begins a reverse cycle defrost operation.

Next, at step ST12, a four-way changeover valve switching flag F11 (which is "1" on the cooling side, "2" on the heating side) is initialized at "0" and, at steps ST13 and ST14, an external fan and an internal fan (both not shown) are caused to stop running respectively. If, at step ST15, the count TD3 of the TD3 timer for actuating the defrost end circuit is 20 seconds or more, or if, at step ST16, there is a current decrease, control proceeds to step ST17 at which the four-way changeover valve switching flag F11 is set to "1" or the cooling side. Then, at step ST18, a valve travel P for the electric expansion valve 5 is set to 200 pulses. At step ST19, the electric expansion valve 5 is opened and the on-off valve SV for gas bypass path 4*a* is closed (at time t2 in FIG. 7). At step 20, the initial defrost flag FD4 is set to "1". In this way, at an initial stage of the defrost operation, the on-off valve SV is closed and the electric expansion valve 5 is opened to a large degree of valve travel, because it is intended that a larger amount of liquid refrigerant is fed into the internal heat exchanger 6 at an early stage of the defrost operation during which the internal heat exchanger 6 is still warm. As the internal heat exchanger 6 becomes chilled, the on-off valve SV for the gas bypass path 4*a* is opened at time t3 in FIG. 7 in order that gas present in the receiver 4 is supplied into the internal heat exchanger 6, as will be described hereinafter.

Upon completion of control steps ST3 through ST20, or when decision at step ST2 is that the initial defrost flag FD4 is "1", control proceeds immediately to step ST21 at which a frequency step value N for the compressor 1 is minimized. Then, at step ST22, the frequency step value N is maximized, and thereafter control proceeds to step ST23 for a deicer temperature control.

In the above described flow, control through step ST11 and the subsequent steps represents the defrost operation control means 51 of the invention, and control at step ST7 represents the before-defrost on-off control means 52.

Figure 4:
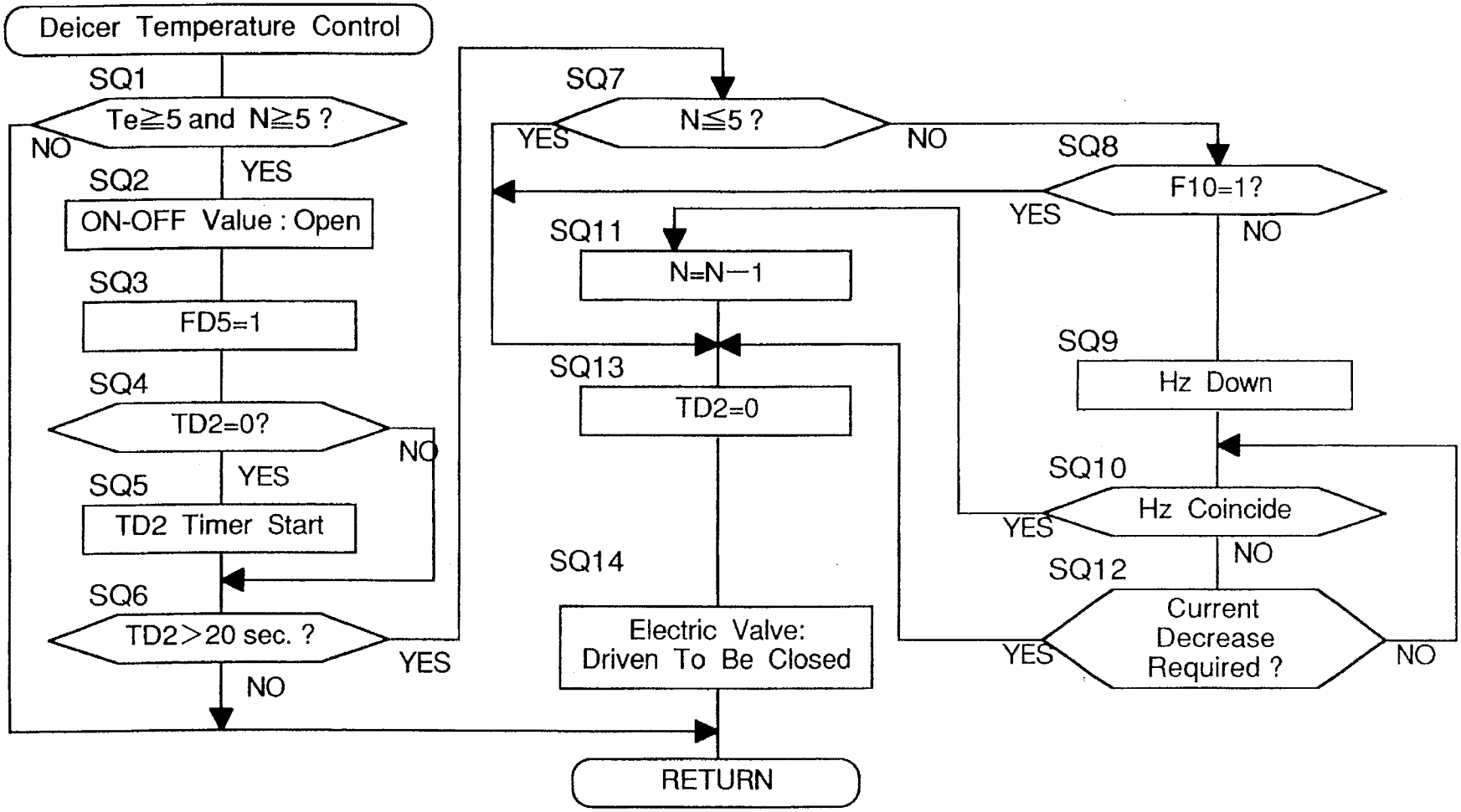
FIG. 4 is a flow chart showing details of deicer temperature control during defrost operation.

Referring next to FIG. 4, the process of the deicer temperature control is shown in details. First, at step SQ1, decision is made whether or not a deicer temperature Te is 5° C. or more and whether or not the frequency step value N is "5" or more, and until Te≧5 and N≧5 are reached, the reverse cycle defrost operation is continued while the on-off valve for the gas bypass path 4a is held in a closed position. When Te≧5 and N≧5, decision is made that frost melting has progressed a predetermined degree, and control proceeds to step SQ2, at which the on-off valve SV for the gas bypass path 4a is opened (at time t3 in FIG. 7) to allow the gas refrigerant in the receiver 4 to be drawn toward the low pressure side so that any pressure decrease on the low pressure side and any liquid back-flow to the compressor 1 are prevented. At step SQ3, a deicer flag FDS, which is "0" when the deicer temperature Te<5° C. and is "1" when Te≧5° C., is changed over to "1". At step SQ4, decision is made whether a count TD2 at a TD2 timer (valve-travel and frequency control timer) is "0" or not. If the decision is not TD2=0, the timer is kept as it is, and if the decision is TD2=0, TD2 timer is set to start at step SQ5, then, in either case, control proceeds-to step SQ6. At step SQ6, decision is made whether count TD2 at TD2 timer has exceeded 20(sec) or not, and when TD2>20(sec), control through step SQ7 and the subsequent steps is carried out.

First, at step SQ7, decision is made whether the frequency step value N is N≦5. If not N≦5, then decision is made at step SQ8 whether or not a frequency flag F10 (a flag for frequency increase due to current and deicer temperature) is "1" which value is an indication of frequency increase. If not F10=1, control proceeds to step SQ9 at which a down signal for lowering the inverter frequency Hz is produced. When, at step SQ10, the frequency Hz coincides with the frequency value for step value N, control proceeds to step SQ11 to give N=N−1, and then, control proceeds to step SQ13. In the above case, while decision at step SQ10 is that the frequency Hz is not in coincidence with the frequency for the step value N, control proceeds to step SQ12 for decision as to whether decrease of a current is required or not. Only when no current decrease is required, the lowering of the frequency Hz is continued, and if there is any requirement for the decrease of the current, control proceeds to step SQ13. If the decision at step SQ7 is N≦5, or if the decision at step SQ8 is F10=1, control proceeds immediately to step SQ13. Through the above described process of control, the frequency step value N is reduced to "5".

At step SQ13, the count TD2 at the TD2 timer, which is a timer for valve travel and frequency control, is reset (TD2=0), and then control proceeds to step SQ14 at which the electric expansion valve 5 is driven to be closed.

In the above described flow of process, control at step SQ2 represents the during-defrost on-off control means 53 of the invention.

In the foregoing control, a point of time at which a predetermined degree of progress has been made in the process of frost melting at the external heat exchanger 3 is judged from a rise in an evaporation temperature Te. However, such a point of time may be judged from a decrease in discharged-gas temperature or a decrease in the low-pressure side temperature, or may be judged from a decrease in the temperature of the internal heat exchanger 6 or from the lapse of a predetermined time after the start of the defrost operation.

Figure 5:
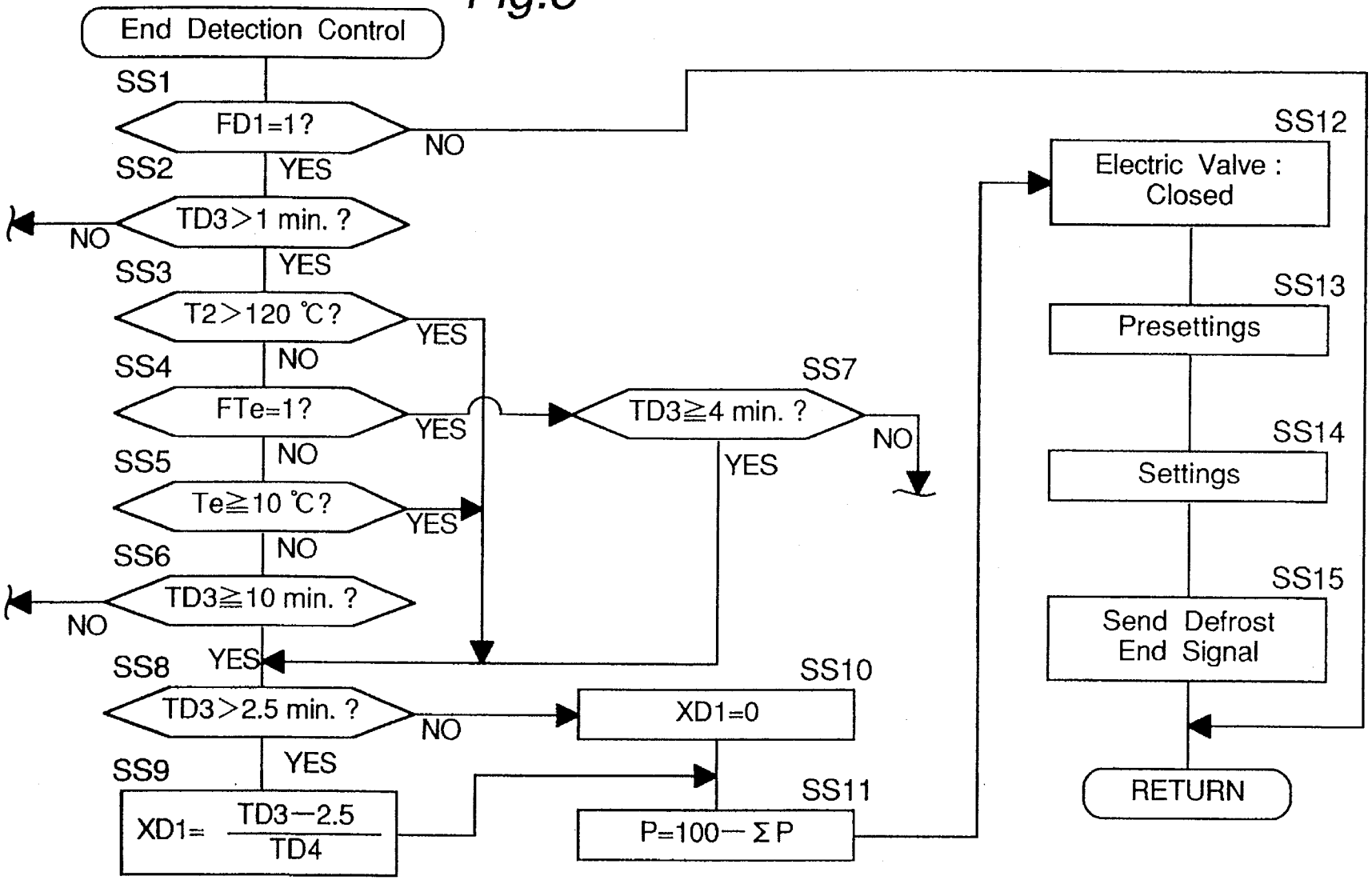
FIG. 5 is a flow chart showing details of defrost end detection control.

Next, the process of a defrost operation-end detection control will be explained with reference to the flow chart of FIG. 5. Initially, at step SS1, decision is made whether the during-defrost flag FD1, with a guard timer for 10 minutes maximum, is "1" or not. Then, only while FD1=1 that is indicative of the defrost operation in progress, control procedure of step SS2 and the subsequent steps is executed.

First, at step SS2, decision is made whether or not the count TD3 at the TD3 timer for actuating the defrost end circuit is 1 minute or more. If TD3>1 (minute), then at step SS3, decision is made whether or not a discharge pipe temperature T2 is in excess of 120° C., at step SS4, decision is made whether or not a deicer abnormal flag FTe (usually "0", but "1" when the deicer Thc is abnormal) is "1", at step SS5, decision is made whether or not the deicer temperature Te is 10° C. or more, and at step SS6 decision is made whether or not the count TD3 at the TD3 timer for defrost end circuit actuation is 10 (minutes) or more. If T2≦120 (° C.), FTe=0, Te<10 (° C.), and TD3≧10 (minutes), then control proceeds to step SS8. If the decision at step SS3 is T2>120 (° C.), or if the decision at step SS5 is Te≧10 (° C.), then control proceeds directly to step SS8. Where the decision at step SS4 is that the deicer abnormal flag FTe=1, control proceeds to step SS7 at which decision is made whether TD3≧4 (minutes) or not. If TD3≧4 (minutes), control proceeds to step SS8. If the decision at step SS2 is not TD3>1 (minute), if the decision at SS6 is not TD3≧10 (minutes), or if the decision at step SS7 is not TD3≧4 (minutes), control for decreasing the current is carried out in each case (details of which control are omitted).

Next, at step SS8, decision is made whether or not the count TD3 of the TD3 timer for defrost end circuit actuation is TD3>2.5 (minutes). If TD3>2.5 (minutes), at step SS9, a defrost variable XD1 for calculating a defrost end time is computed on the basis of XD1=(TD3−2.5)/TD4 (where, TD4 is an integrated heating operation time). If not TD3>2.5 (minutes), at step SS10, setting is made to XD1=0. In either case, control then proceeds to step SS11.

At step SS11, valve travel P of the electric expansion valve 5 is set to P=100−ΣP, and at step SS12 the electric expansion valve 5 is closed. Then, at step SS13, presettings for the defrost end operation are made which include resetting of TD4 timer, a timer for measurement of the integrated heating operation time, to make the timer start counting, and halting (holding) of run of the TD3 timer for defrost end circuit actuation. At step SS14, flags FD1, FD4, and FD5 are set to FD1=0, FD4=0, and FD5=0 respectively. Further, the after-defrost flag FD3, which is "1" when the defrost operation ends, is set to "1" and, as will be further described hereinafter, an after-end 3-minutes flag FD2, which is "0" upon lapse of 3 minutes after the end of the defrost operation, is set to "1". Additionally, an end timer TD6 for defrost ending operation is reset for commencement of its counting. Finally, at step SS15, a defrost end signal is output.

In other words, completion of defrosting is, in principle, detected when the deicer temperature Te is 10° C. or more or when the discharge pipe temperature T2 exceeds 120° C., but in the event of the deicer The being abnormal, the defrost time is set to 4 minutes (or T2>120 (° C.)). Furthermore, a guard is provided such that the defrost operation time is 10 minutes maximum.

Next, the process of defrost ending control will be explained with reference to the flow chart of FIG. 6. First, at step SR1, decision is made whether or not the after-end flag FD3 is "0", and only where setting is FD3=1, the following procedure of control is carried out.

At step SR2, the four-way changeover valve 2 is switched to an "on" position, that is, switched over to the heating cycle (time t4 in FIG. 7), then at step SR3, the four-way changeover valve switching flag F11 is initialized at "0", and at step SR4, external fan control is effected. Then, at step SR5, decision is made whether or not the count TD6 at the end timer TD6, which has started counting upon the four-way changeover valve 2 being switched over to the "on" position (heating side), is 10 seconds or more. When TD6≧10 (seconds), then at step SR6 the four-way changeover valve switching flag 11 is set to "2" on the heating side, and at step SR7 the frequency step value N is reduced to 2, a minimum value.

Next, at step SR8, decision is made whether or not TD6>10 (minutes), that is, whether or not 10 minutes have passed after the four-way changeover valve 2 was switched over to the heating side. If not TD6>10 (minutes), at step SR9, a maximum frequency Nmax for the compressor 1 is set to Nmax=INT (0.6 Nt)(where, Nt is a rated frequency which is determined according to machine type) until 10 minutes has lapsed after the end of the defrost operation. If TD6>10 (minutes), then at step 10, Nmax is set to Nmax= MAX–N (where, MAX–N is a maximum frequency value preset according to machine type). Then, in either case, control proceeds to step SR11. Limitation on maximum frequency Nmax is relaxed by maximum 1N for each 60 seconds through normal control, but under the foregoing control, the maximum frequency Nmax is subject to a limitation of 0.6 Nt before the lapse of 10 minutes. Therefore, after the limit of 0.6 Nt is reached, any further frequency increase is impossible. However, after the lapse of 10 minutes, an increase of maximum 1N for each 60 seconds in the upper limit of the frequency is again rendered possible, and thereafter there may be a continued increase in the maximum frequency Nmax until the maximum frequency Nmax reaches MAX-N.

Where the decision at step SR5 is TD6<10 (seconds), control proceeds to step SR11, skipping the control at SR6 through SR10.

At SR11, decision is made whether or not the time TD6 after the defrost end is TD6>30 (minutes). Until TD6>30 (minutes) is reached, decision is made whether TD6≧3 (minutes) at step SR12, and until TD6≧3 is reached, control procedure of step SR13 and the subsequent steps is carried out.

At steps SR13 and SR14, decisions are made whether TD6>20 (seconds) or not, and whether or TD6<40 (seconds) or not, respectively. If TD6≦20 (seconds), then at step SR16, the on-off valve SV for the gas bypass path 4*a* is closed (time t4–t5 in FIG. 7) until the specified time of 20 seconds has lapsed after the operation returns to the heating cycle. By this it is intended that the liquid refrigerant stored in the external heat exchanger be prevented from being sucked into the compressor 1. For a subsequent period of 20 (seconds)<TD6<40 (seconds), at step SR15, the on-off valve SV is opened (time t5–t6). When TD6≦40 (seconds) is reached, the on-off valve SV is closed (at and after the time t6 in FIG. 7) at step SR16. Through this process, as will be described in detail hereinafter, liquid flow-back in the compressor 1 is prevented while pressure on the high pressure side is properly kept.

When the on-off valve SV is opened at the time point of t5 in FIG. 7, control procedure of steps SR17 through SR20 is carried out for holding the valve travel of the electric expansion valve 5 at 50 pulses. Then, control proceeds to step SR21. It is noted that at steps SR19 and SR20 the electric expansion valve 5 is designated by characters "EV".

In the present example, the opening and closing of the on-off valve SV, at times t5 and t6 in FIG. 7, is effected by way of the lapse of a predetermined time, but such opening and closing may be effected on the basis of the temperature at the internal heat exchanger 6 or the pressure on the high pressure side.

Next, at step SR21, a frequency drive offset variable X7 is set to "3" and, at step SR22, decision is made whether or not a variable XD4 related to the outdoor temperature prior to the beginning of the defrost operation is 10° C. or more. If XD4≧10 (° C.), then at step SR23, control is effected to give P=f1(N). If not XD4≧10 (° C.), then at step SR24, control is effected to give P=f2(N). Then, in either case, control proceeds to step SR25 at which valve travel control is made with respect to the electric expansion valve 5. In the above, f1(N)=0.5N+0.5, and f2(N)=0.3N+0.1. Through this control, valve travel ΣP increases in proportion as the frequency Hz increases. Meanwhile, the valve travel of the electric expansion valve 5 is also controlled by normal control (expressed by the relation P=f(Hz, dNx, EP)) as well. In effect, therefore, the valve travels effected by the two ways of control are added up.

In the foregoing process, when the decision at step SR12 is TD6≧3 (minutes), control proceeds to step SR26. If the frequency drive offset variable X7 is "3", then at step SR27, the variable X7 is reset to "0" . the frequency variable X7 is not "3", it is held as it is. Then, in either case, control proceeds to step SR28 at which the after-end 3-minutes flag FD2 is set to "0" Meanwhile, with the start of the heating operation, the internal fan has been already brought into an operating condition.

With further lapse of time, when, at step SR11, decision with respect to count TD6 at the TD6 timer for measurement of time lapse after the end of the defrost operation is TD6>30 (minutes), control proceeds to step 29 at which the count of the TD6 timer is reset to 0 (TD6=0). At step SR30, the LPS mask, which inhibits actuation of the low pressure-side pressure switch LPS, is freed or cancelled, and at step SR31, the after-defrost flag FD3 is switched over to FD3=0. Thereupon, the process of control is completed.

In the above described flow, the control procedures of step SQ14 and steps SR13 through SR20 represent the after-defrost on-off control means 54 of the present invention.

In this way, according to the present embodiment, when a defrost command is issued during the heating operation, the on-off valve SV for the gas bypass path 4*a* is opened by the before-defrost on-off control means 52 before the commencement of the reverse cycle defrost operation (at t0 in FIG. 7) by the defrost operation control means 51, so that the pressure in the receiver 4 is lowered, which results in inflow into the receiver 4 of liquid refrigerant present in the internal heat exchanger 6 which has been acting as a condenser. Therefore, a changeover to the reverse cycle defrost operation is possible in such a condition that little or no liquid refrigerant is retained in the internal heat exchanger 6. This enables liquid back-flow into the compressor 1 to be effectively prevented.

When the before-defrost on-off control means 52 controls the on-off valve SV to open from before a changeover to the reverse cycle until after the changeover, gas refrigerant is introduced into the internal heat exchanger 6, which is now acting as an evaporator, as a result of the on-off valve SV being opened after the changeover to the reverse cycle. Thus, any liquid back-flow after the changeover to the reverse cycle can be more effectively prevented.

After the commencement of a reverse cycle defrost operation and as frost melting at the external heat exchanger 3 progresses, the temperature in the external heat exchanger 3 goes up, whereas the temperature in the internal heat exchanger 6 is lowered. As a result, the pressure on the lower pressure side is lowered and the incoming refrigerant tends to get wet. At that point of time (t3 in FIG. 7) the on-off valve for the gas bypass path 4a is opened by the during-defrost on-off control means 53 so that gas refrigerant is introduced into the internal heat exchanger 6 which is acting as an evaporator. As a result, any excessive pressure decrease on the low pressure side is prevented, and the wetting condition of the refrigerant is eliminated. Further, any liquid back-flow into the compressor 1 is prevented.

At the end of the defrost operation (at t4 in FIG. 7), the internal heat exchanger 3 which has been acting as a condenser is switched over to an evaporator. For a predetermined time (t4–t5 in FIG. 7), however, the electric expansion valve 5 and the on-off valve SV are closed under the control of the after-defrost valve control means 54. Therefore, no supply of refrigerant is made to the external heat exchanger 3 during that time and any liquid back-flow from the external heat exchanger 3 toward the compressor 1 is prevented.

When the on-off valve SV is allowed to remain closed, the internal heat exchanger 6 which has been acting as an evaporator is made to act as a condenser, with the pressure therein being low (e.g., on the order of 0.5 kg/cm$^2$), while the pressure in the receiver 4 is high (e.g., on the order of 10 kg/cm$^2$). This unfavorably affects the flow of refrigerant from the internal heat exchanger 6 to the receiver 4, with the result that inflow of discharged refrigerant from the compressor 1 may not possibly supplied to the receiver 4. Therefore, it is possible that the pressure on the high pressure side be abruptly increased to develop a high pressure cut. As such, according to the present invention, upon lapse of a predetermined time after the changeover to the heating cycle (t5 in FIG. 7), the valve travel of the electric expansion valve 5 is controlled by the after-defrost valve control means 54 to a small degree of valve travel (50 pulses in the foregoing example), and the on-off valve SV is opened to allow refrigerant to flow from the internal heat exchanger 6 into the receiver 4, so that any excessive increase in the pressure on the high pressure side is suppressed and any high pressure cut is prevented. Further, upon a subsequent lapse of a specified time (t6 in FIG. 7), the electric expansion valve 5 is controlled to a controlled degree of valve travel and the on-off valve SV is controlled to be closed. Thus, return to the heating operation can be smoothly effected. Therefore, it is possible to effectively prevent any liquid back-flow to the compressor 1 while maintaining the pressure on the high pressure side at a proper level.

In particular, adoption of such accumulatorless construction as the above described embodiment provides for reduction in costs and improvement in performance, with a liquid-back preventive function maintained through control of the on-off valve SV and electric expansion valve 5.

In the above described embodiment, the on-off valve SV is opened for a predetermined time before and after the commencement of defrost operation, but it may be opened for a predetermined time only prior to the start of defrost operation.

INDUSTRIAL APPLICABILITY

As described above, the system for controlling operation of a refrigerating device in accordance with the invention is applicable to air conditioning apparatuses and refrigerating apparatuses which are designed to perform reverse cycle defrost operations.

We claim:

1. A system for controlling operation of a refrigerating device which includes a refrigerant circuit in which a compressor, a condenser, a receiver for storing liquid refrigerant, a pressure-reducing valve, and an evaporator are connected together, and a cycle change-over mechanism for changing a refrigeration cycle of the refrigerant circuit between forward operation and reverse operation, the pressure-reducing valve being positioned downstream of the receiver during either one of the refrigeration cycles, the system comprising:

a bypass path connecting a top portion of the receiver to a liquid line on a downstream side of the pressure-reducing valve;

a normally closed on-off valve for opening and closing said bypass path;

defrost operation control means for switching the cycle change-over mechanism to a reverse cycle position upon receipt of a defrost command during operation of the refrigerating device, thereby controlling the device so as to perform a defrost operation; and at least one of (a) before-defrost on-off control means for controlling the on-off valve to be opened for at least a predetermined period of time preceding a change-over to a reverse cycle operation via the defrost operation control means, (b) during-defrost on-off control means for controlling the on-off valve to be opened during a reverse cycle defrost operation effected through the defrost operation control means, from a time at which melting of frost built on the evaporator has progressed a predetermined degree until completion of the defrost operation, and (c) after-defrost valve control means for controlling the on-off valve and the pressure-reducing valve such that after completion of the reverse cycle defrost operation effected by the defrost operation control means, the on-off valve and the pressure reducing valve are closed for a predetermined time and thereafter the on-off valve is opened for a predetermined time while the pressure reducing valve is opened a predetermined low degree of valve travel.

2. The system for controlling operation of a refrigerating device as set forth in claim 1, wherein said before-defrost on-off control means is operative to control the on-off valve to be opened from a time before the change-over to the reverse cycle until a time after the change-over to the reverse cycle.

3. The system for controlling operation of a refrigerating device as set forth in claim 1, wherein said evaporator is connected to the compressor without an accumulator interposed therebetween.

4. The system for controlling operation of a refrigerating device as set forth in claim 1, wherein said condenser is connected to the compressor without an accumulator interposed therebetween.

5. The system for controlling operation of a refrigerating device as set forth in claim 2, wherein said evaporator is connected to the compressor without an accumulator interposed therebetween.

6. The system for controlling operation of a refrigerating device as set forth in claim 2, wherein said compressor is connected to the compressor without an accumulator interposed therebetween.

* * * * *